US006323741B1

(12) United States Patent
Kim

(10) Patent No.: US 6,323,741 B1
(45) Date of Patent: Nov. 27, 2001

(54) MICROSTRIP COUPLER WITH A LONGITUDINAL RECESS

(75) Inventor: Dong Wook Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/414,719

(22) Filed: Oct. 12, 1999

(30) Foreign Application Priority Data

Oct. 13, 1998 (KR) ..... 98-42851

(51) Int. Cl.[7] ..... H01P 5/18

(52) U.S. Cl. ..... 333/116; 333/24 R

(58) Field of Search ..... 333/116, 202, 333/204, 24 R; 385/41

(56) References Cited

U.S. PATENT DOCUMENTS 3,659,228 * 4/1972 Napoli ..... 333/16

* cited by examiner

*Primary Examiner*—Justin P. Bettendorf
*Assistant Examiner*—Dean Takaoka
(74) *Attorney, Agent, or Firm*—Fleshner & Kim, LLP

(57) ABSTRACT

Microstrip coupler and method for fabricating the same, which can improve a directivity while does not affect to an active device disposed on the same substrate, the microstrip coupler, including an insulating substrate having a dielectric constant, one pair of coupled microstrip lines having a width spaced a distance from each other, extended in a longitudinal direction, and disposed on one side of the insulating substrate, and a recess formed in the insulating substrate on a side of a grounded member opposite to the microstrip lines with a width and a depth disposed in the longitudinal direction.

6 Claims, 6 Drawing Sheets

MICROSTRIP COUPLER WITH A LONGITUDINAL RECESS

BACKGROUND OF THE INVENTION

1. Field of the Invention

The present invention relates to a microstrip coupler and a method for fabricating the same, in which a difference of an odd mode phase velocity and an even mode phase velocity of the microstrip coupler is reduced for improving a directivity, a ratio of a coupling to an isolation, of the coupler.

2. Background of the Related Art

Of the transmission lines used widely in extreme high frequency wave and microwave circuits, there is a coupled line, in which energy is exchanged through coupling between the transmission lines to transmit or cut off an energy to a particular terminal. This coupled line has two forms of mode characteristics, i.e., either in an even-mode or in an odd-mode, as the characteristics of the coupled line structure are, in which field distributions and phase velocities differ.

FIG. 1 illustrates a related art microstrip directional coupler schematically. When a power $P_1$ is supplied to an input, one side port of the microstrip line 11, if it is assumed that a power at a through port is $P_2$, a power at a coupled port of a coupled adjacent microstrip line 12 is $P_3$, and a power at an isolated port is $P_4$, a coupling C, an isolation I and a directivity D, major three parameters that form a directional coupler, can be expressed as equation (1), below.

$$C=10\log(P_1/P_3)=-20\log\beta[\mathrm{dB}]$$

$$D=10\log(P_3/P_4)=20\log(\beta|S_{14}|)[\mathrm{dB}]$$

$$I=10\log(P_1/P_4)=-20\log(|S_{14}|)[\mathrm{dB}]$$

Where $\beta$ denotes a scattering coefficient $|S_{13}|$.

The directivity D is inversely proportional to an index D' that represents an undesired coupling, that can be expressed as equation (2).

$$D'=[\pi\Delta(1-|\xi|^2)/(4|\xi|)]^2$$

where, $\Delta=(\beta e-\beta o)/\beta o$ $$\xi=\rho_e/(1+\rho_e^2)-\rho_o/(1+\rho_o^2)$$

$$\rho_e=(Zoe-Zo)/(Zoe+Zo)$$

$$\rho_o=(Zoo-Zo)/(Zoo+Zo)$$

$\beta e$ and $\beta o$ represent an even mode phase velocity and an odd mode phase velocity respectively, and Zoe and Zoo represent characteristic impedances in the even mode and in the odd mode, respectively. Zo represents a characteristic impedance of a transmission line, set in general at 50 Ω in a microwave measuring environment. Since a directivity of a directional coupler represents how well a forward wave component and a reverse wave component are separated, an object to which the directional coupler is applied requires a high directivity. If the directivity is poor, accuracy of a reflect meter deteriorated, to cause a change a power level $P_3$ of the coupled port coming from the coupler even if there is a slight mismatch to the power $P_2$ transmitted to the through line. Due to this, there have been various efforts for improving the directivity, which are directed to a method of leading the Δ to zero in the equation 2, i.e., minimizing a difference between an odd mode phase velocity and an even-mode phase velocity coming from the microstrip structure which is formed in a structure having a dielectric inhomogeneity.

Referring to FIG. 2, the example of a related art microstrip coupler is provided with a substrate 10 with a height h and dielectric constant ∈r formed on a grounded member 14, one pair of coupled microstrip lines 11 and 12 each with a width 'W' and spaced 'S' to each other, and an electric shielding metal 13 spaced 'd' from the substrate 10 above the microstrip lines 11 and 12. The electric shield film 13 is placed in an air medium. The related art microstrip coupler having the electric shielding metal 13 redistributes a substantial amount of field in the air medium positioned above the coupled microstrip lines by means of the electric shielding metal. Therefore, since the even-mode phase velocity and the odd-mode phase velocity become the same in a condition of d=h theoretically, the above equation (2) Δ [=(βe−βo)/βo] becomes zero, to improve a directivity.

FIG. 3 illustrates a section of a related art microstrip coupler in which a directivity is improved by using lumped capacitors, schematically.

Referring to FIG. 3, another related art example is a structure in which a lumped capacitors 15 and 16 is inserted in both ends of a section of the coupled microstrip lines 11 and 12 disposed on the substrate 10. A difference between this related art example and the previous related art example is provision of the lumped capacitors 15 and 16 on both ends of the microstrip lines 11 and 12 instead of the electric shielding metal 13 of FIG. 2 disposed in an air medium over the microstrip lines 11 and 12. Identical components for this related art example and the previous related art example are given the same reference numerals, and explanations for the same will be omitted. Because this related art has capacitors 15 and 16 inserted at opposite ends of a section of the coupled one pair of microstrip lines 11 and 12, an odd-mode phase angle can be increased effectively, that leads the Δ [=(βe−βo)/βo] to zero, to improve the directivity.

FIG. 4 illustrates a section of a related art microstrip coupler in which a directivity is improved by using an overlay material, schematically.

Referring to FIG. 4, the another example of a related art microstrip coupler is provided with a substrate 10 with a height h and dielectric constant ∈r, one pair of coupled microstrip lines 11 and 12, and a medium 17 with a dielectric constant ∈r, the same as the substrate 10, overlaid to enclose the coupled one pair of microstrip lines 11 and 12. In this example of a related art, since a medium having the same dielectric constant ∈r with the substrate is laid on the coupled microstrip lines 11 and 12, the odd-mode phase velocity is reduced, to be the same as the even-mode phase velocity, that improves the directivity. In this case, phase velocities both in the even-mode and in the odd-mode can be adjusted very accurately by adjusting a thickness and a width of the overlaid material.

However, the coupled microstrip lines in all the related arts adjusts the odd-mode phase velocity either by providing capacitors, overlaying the electric shielding metal or a medium with the same dielectric constant as that of the substrate having the coupled microstrip lines formed thereon. Therefore, though there is no problem when the microstrip lines, a passive device, is used solely, in a case when a semiconductor device, an active device, is disposed on the same substrate, there has been a problem in that it is difficult to use the microstrip lines in an MMIC(Monolithic Microwave Integrated Circuit) in which use of a shield is not generalized or in a millimeter wave integrated circuit in which use of an overlay material is limited because a thickness and kind of the overlay dielectric material affects to characteristics of the active device seriously.

SUMMARY OF THE INVENTION

Accordingly, the present invention is directed to a microstrip coupler and a method for fabricating the same that substantially obviates one or more of the problems due to limitations and disadvantages of the related art.

An object of the present invention is to provide a microstrip coupler and a method for fabricating the same, which can improve a directivity while does not affect to an active device disposed on the same substrate.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the microstrip coupler includes an insulating substrate formed on a conductive grounding member having a dielectric constant, one pair of coupled microstrip lines having a width spaced a distance from each other, extended in a longitudinal direction, and disposed on one side of the insulating substrate, and a recess formed in the insulating substrate on a side of a grounded member opposite to the microstrip lines with a width and a depth disposed in the longitudinal direction.

In other aspect of the present invention, there is provided a method for fabricating a microstrip coupler, including the steps of (1) providing an insulating substrate, (2) forming a recess opposite to one pair of microstrip lines having a width spaced a distance from each other, extended in a longitudinal direction, and disposed on one side of the insulating substrate, (3) stuffing the recess with a material having a dielectric constant smaller than a dielectric constant of the insulating substrate, and (4) depositing a grounding metal film on the other side of the insulating substrate inclusive of the recess.

In another aspect of the present invention, there is provided a method for fabricating a microstrip coupler, including the steps of (1) providing an insulating substrate, (2) depositing a metal film on one side of the insulating substrate by photolithography, and forming one pair of microstrip lines having a width spaced a distance from each other, extended in a longitudinal direction, and disposed on one side of the insulating substrate, (3) conducting patterning to a required pattern by photolithography, and depositing a grounding metal film on the other side of the insulating substrate, and (4) using the patterned metal film as a mask in etching the insulating substrate to form a recess.

The patterning in the step (3) forms a pattern having bridges each with a width disposed at fixed intervals extended in a longitudinal direction along the microstrip lines, and the recess formed by using the pattern as a mask is filled with air.

While the related art methods show adjustment of the odd-mode phase velocity, the present invention adjusts the even-mode phase velocity for improving a directivity, wherein an odd-mode wave, in a form of a slot, has a field distributed mostly on a surface of the substrate, the even-mode wave, in a form of a microstrip form and the present invention employs, has a field mostly distributed on a material $\in r$ between a transmission line and a back side grounding substrate.

The greater the effective dielectric constant, the smaller the phase velocity, and the smaller the effective dielectric constant, the greater the phase velocity.

Therefore, by providing the recess in a surface of the substrate in contact with the ground and stuffing the recess with a material having a dielectric constant smaller than a dielectric constant of the recess, an overall effective dielectric constant can be reduced, which permits an increase of the even-mode wave phase velocity, to be the same as the odd-mode wave phase velocity, that allows to dispense with an adjustment means which gives an influence to characteristics of the active device on a surface of an insulating substrate for adjusting the phase velocities of the even-mode wave and the odd-mode wave the same when a substrate the same with the active device is used, thereby improving a directivity of the coupler while keeping characteristics of the active device in a good state.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
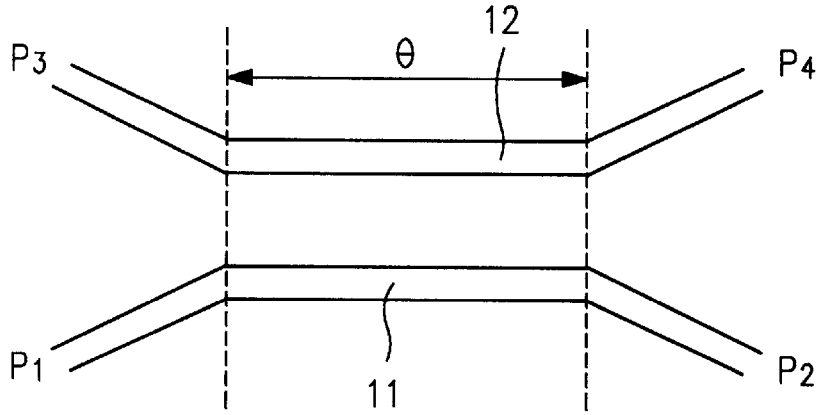
FIG.1 BACKGROUND ART
FIG. 1 illustrates a related art microstrip directional coupler schematically.
Figure 2:
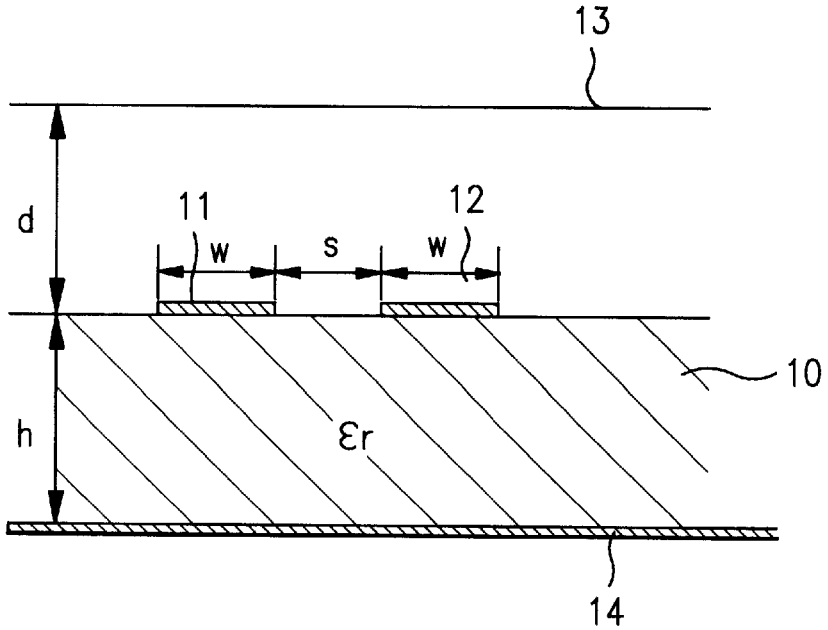
FIG.2 BACKGROUND ART
FIG. 2 illustrates a section of a related art microstrip coupler in which a directivity is improved using a shielding metal, schematically.
Figure 3:
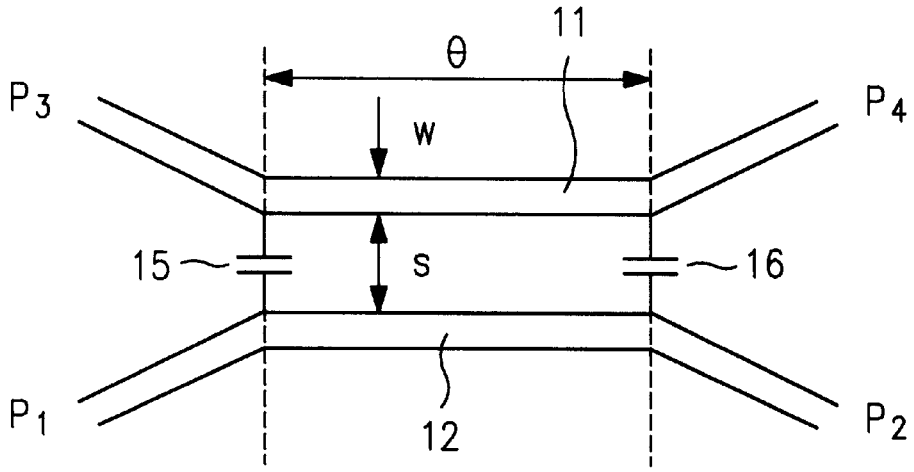
FIG.3 BACKGROUND ART
FIG. 3 illustrates a section of a related art microstrip coupler in which a directivity is improved by using lumped capacitors, schematically.
Figure 4:
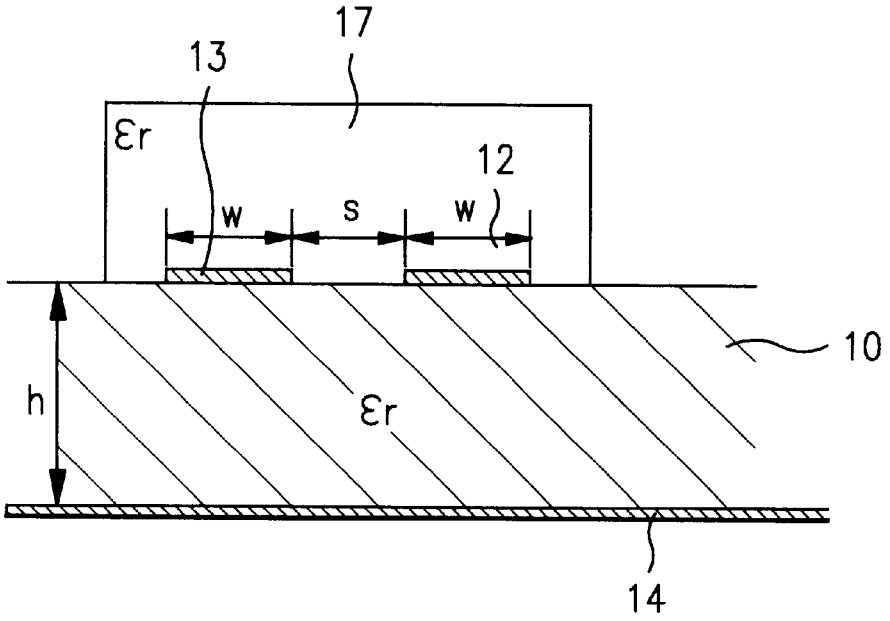
FIG.4 BACKGROUND ART
FIG. 4 illustrates a section of a related art microstrip coupler in which a directivity is improved by using an overlay material, schematically.
Figure 5:
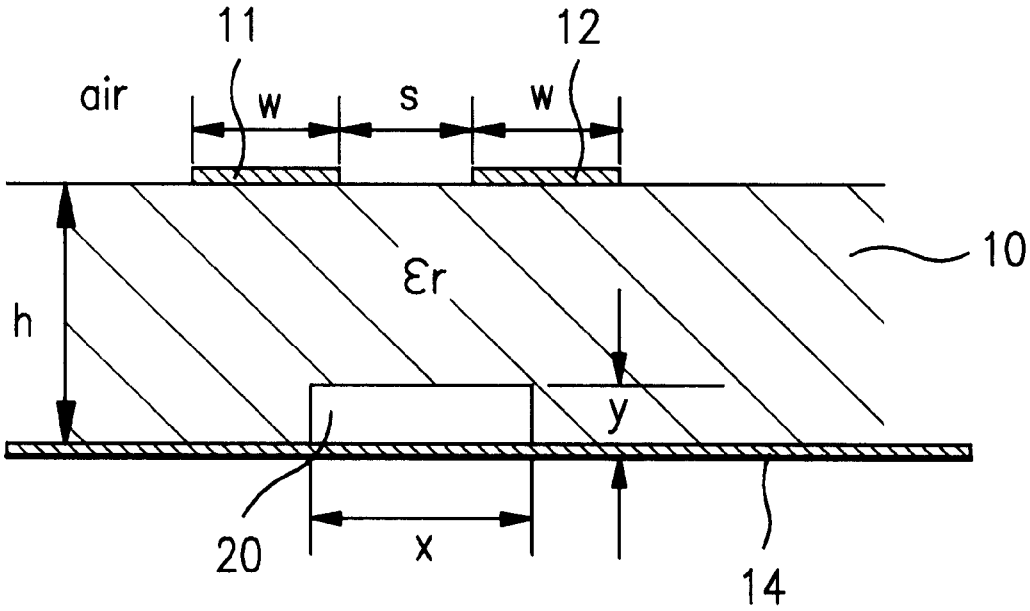
FIG. 5 illustrates a section of a microstrip coupler in accordance with a preferred embodiment of the present invention, schematically.

Reference will now be made in detail to the preferred embodiments of the present invention, examples of which are illustrated in the accompanying drawings. FIG. 5 illustrates a section of a microstrip coupler in accordance with a preferred embodiment of the present invention, schematically.

Referring to FIG. 5, a microstrip coupler in accordance with a preferred embodiment of the present invention includes an insulating substrate 10 having a height 'h' and a dielectric constant '$\in r$' formed on a grounded member 14, and one pair of coupled microstrip lines 11 and 12 at one side of the insulating substrate 10 each with a width 'W' and spaced 'S' and extended in a longitudinal direction, wherein the insulating substrate 10 has a recess 20 with a width 'X' and a depth 'y' along the longitudinal direction on a side thereof facing the grounded member 14 opposite to the microstrip lines 11 and 12. By adjusting the width 'X' and the depth 'y' appropriately, the recess 20 can increase an even mode phase velocity of the coupled strips to be the same with the odd-mode phase velocity. The recess 20 is stuffed with a material having a dielectric constant ∈r' smaller than the dielectric constant ∈r of the insulating substrate(∈r>∈r') or air. And, as explained later, by forming partitions 34 of a material having a dielectric constant the same with the insulating substrate 10 along the longitudinal direction in the recess 20 with the recess 20 filled with air, degrees of freedom of the width 'X' and the depth 'y' can be made greater in design because, not only the width 'X' and the depth 'y', but also a width 'z' and an interval 'l' of the partitions 34 can be adjusted such that the even-mode phase velocity and the odd-mode velocity become the same. By providing the recess 20 in the longitudinal direction on the substrate 10 at a side facing the grounded member 14 opposite to the one pair of microstrip lines 11 and 12 and stuffing the recess 20 with a material having a dielectric constant smaller than the insulating substrate 10 or air, the microstrip coupler of the present invention can drop an effective dielectric constant in a microstrip mode, and can increase the even-mode phase velocity the same as the odd-mode phase velocity by adjusting the width 'x' and the depth 'y' because the field in the odd-mode is concentrated on a surface of the insulating substrate, and is almost not affected by the recess. Therefore, the Δ in the equation (2) can be made zero, permitting to improve the directivity of the microstrip coupler, significantly. Though the present invention suggests to use a backside process, such as back-side via hole, the present invention is very useful in a case when the overlay material can not be used as wanted because the present invention does not affect to characteristics of an active device.

Figure 6A:
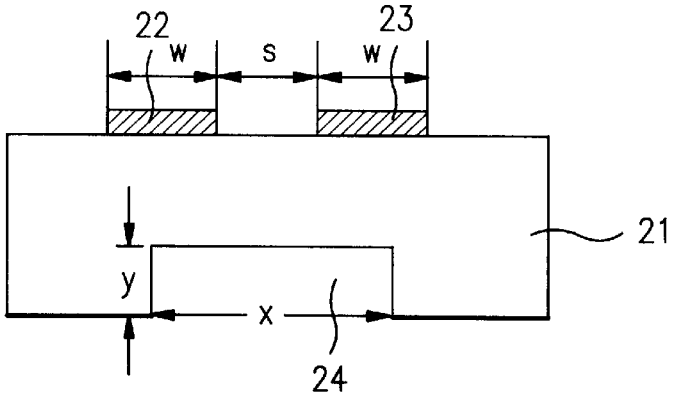
FIGS. 6A~6C illustrate sections showing the steps of a method for fabricating a microstrip coupler in accordance with a preferred embodiment of the present invention; and, FIGS. 7A~7D illustrate sections and a back side showing the steps of a method for fabricating a microstrip coupler in accordance with a another preferred embodiment of the present invention.
Figure 6B:
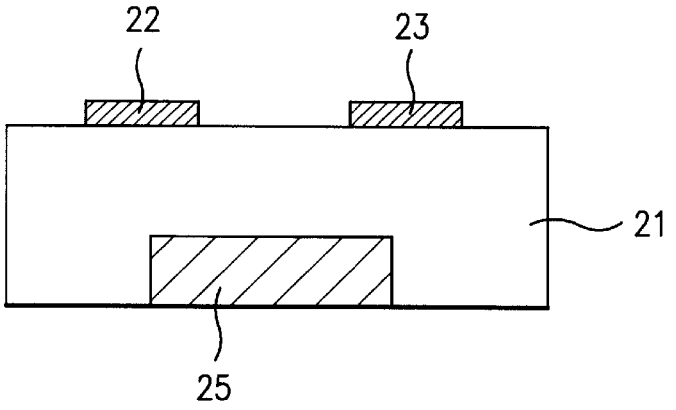
Figure 6C:
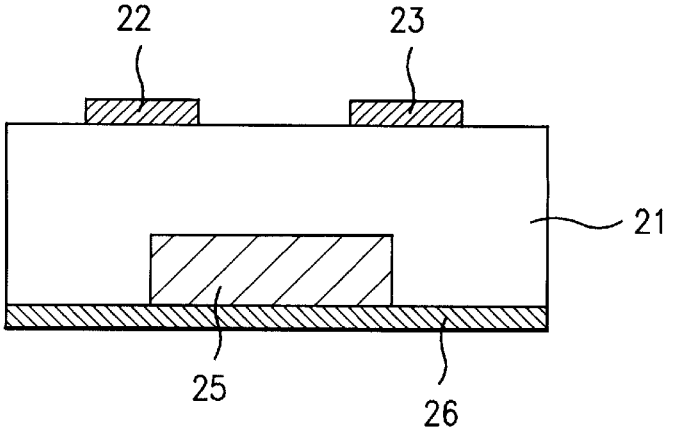

A method for fabricating a microstrip coupler in accordance with a preferred embodiment of the present invention will be explained. FIGS. 6A~6C illustrate sections showing the steps of a method for fabricating a microstrip coupler in accordance with a preferred embodiment of the present invention.

One pair of coupled microstrip lines 22 and 23 are formed by photolithography on one side of an insulating substrate 21 having a dielectric constant '∈r' and a height 'h', each of which has a width 'W', and is spaced 'S' and extended in a longitudinal direction. Then, a recess 24 is formed on the other side of the insulating substrate 21, which has a width 'X' and a depth 'y', and is extended in a longitudinal direction by photolithography. Then, as shown in FIG. 6B, a material 25 having a '∈r' smaller than the '∈r' of the insulating substrate 21 is stuffed in the recess 24 and the surface of the insulating substrate 21 is planarized. As shown in FIG. 6C, a metal film 26 is deposited on the other side of the insulating substrate 21 inclusive of the recess 24, thereby completing the fabrication process.

FIGS. 7A~7D illustrate sections and a back side showing the steps of a method for fabricating a microstrip coupler in accordance with another preferred embodiment of the present invention.

Figure 7A:
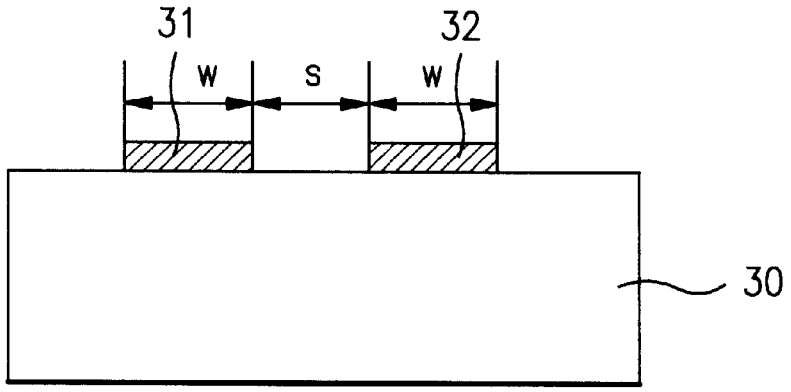
Figure 7B:
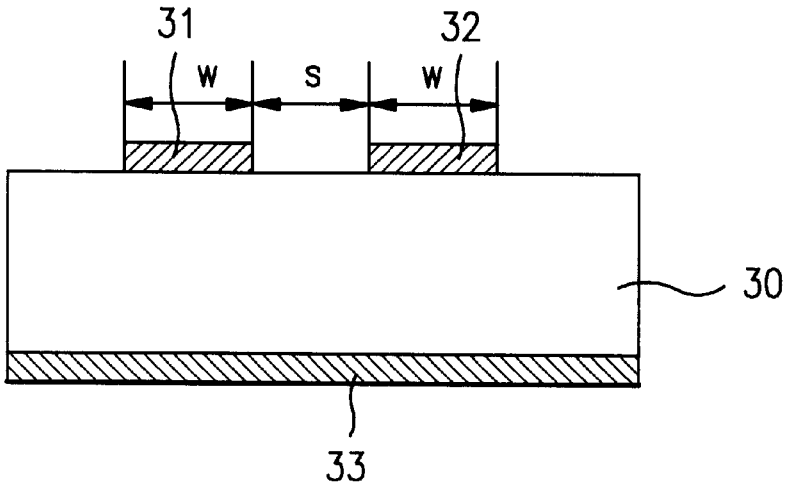
Figure 7C:
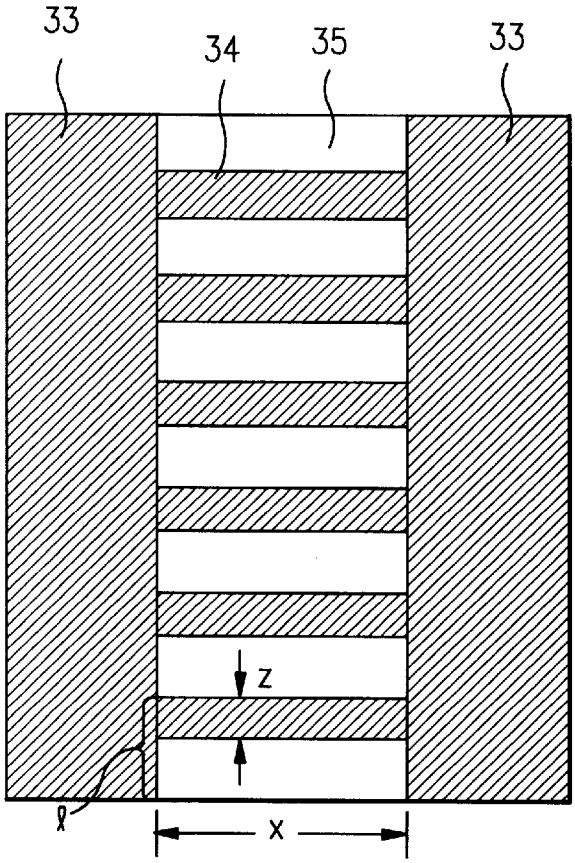
Figure 7D:
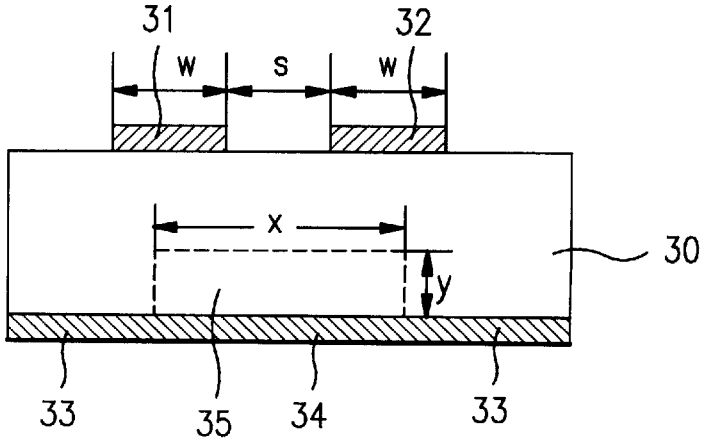

Referring to FIG. 7A, one pair of coupled microstrip lines 31 and 32 are formed by photolithography on one side of an insulating substrate 30 having a dielectric constant '∈r' and a height 'h', each of which has a width 'W', and is spaced 'S' and extended in a longitudinal direction. Then, as shown in FIG. 7B, a metal film for grounding is deposited on the other side of the insulating substrate 30 and lifted-off. As shown in a back side view of FIG. 7C, the metal film shown in FIG. 7B can be formed by patterning the grounding metal film 33 by using a pattern which exposes in forms of successive islands in a longitudinal direction for removing metal film portions in recesses, each of which recesses is formed at fixed intervals l in the longitudinal direction by a bridge 34 connecting both sides of the grounding metal film 33 formed opposite to the microstrip lines 31 and 32 by using a conventional photolithography process. As shown in FIG. 7D, the patterned grounding metal film mask is used in forming the recess 35 by etching the insulating substrate 30. In comparison to the method of the present invention shown in FIGS. 6A~6C, the method of this embodiment layouts the recesses in forms of islands in a longitudinal direction, and adjusts the intervals l, widths 'z', the width 'X', and the depth 'y' on the same time, to increase the even-mode phase velocity, to be the same with the odd-mode phase velocity. Therefore, the method of this embodiment can provides degrees of freedom for setting the width 'X'0 and the depth 'y' higher than the method of the embodiment shown in FIGS. 6A~6C.

As has been explained, by providing a recess in a back side of an insulating substrate, which gives no influence to characteristics of a circuit and stuffing the recess with a material having a dielectric constant smaller than the insulating substrate or air for reducing an overall effective dielectric constant, the microstrip coupler of the present invention in a microwave or millimeter wave circuit in which MMIC, in which generally shield is not used, or an active device, in which kind and thickness of an overlay dielectric material give influences to the circuit characteristics strongly, are formed on the same substrate, can adjust the even-mode wave phase velocity the same with the odd-mode wave phase velocity, thereby improving a directivity of a microstrip coupler when applied to the microwave or millimeter circuit in which the active device which has a limitation in using an overlay material is used on the same substrate.

It will be apparent to those skilled in the art that various modifications and variations can be made in the microstrip coupler and a method for fabricating the same of the present invention without departing from the spirit or scope of the invention. Thus, it is intended that the present invention cover the modifications and variations of this invention provided they come within the scope of the appended claims and their equivalents.

What is claimed is:

1. A microstrip coupler, comprising:

an insulating substrate having a dielectric constant;

one pair of coupled microstrip lines having a width spaced a distance from each other, extended in a longitudinal direction, and disposed on one side of the insulating substrate; and, a recess formed in the insulating substrate on a side of a grounded member opposite to the microstrip lines with a width and a depth disposed in the longitudinal direction, wherein the recess further includes partitions formed of the same material as the insulating substrate disposed along the longitudinal direction with fixed intervals and a thickness.

2. A microstrip coupler as claimed in claim 1, wherein the insulating substrate is formed on a conductive grounded member.

3. A microstrip coupler as claimed in claim 1, wherein the recess is stuffed with air.

4. A microstrip coupler as claimed in claim 1, wherein the recess is stuffed with a material having a dielectric constant smaller than a dielectric constant of the insulating substrate.

5. A microstrip coupler, comprising:

an insulating substrate having a dielectric constant;

one pair of coupled microstrip lines having a width spaced a distance from each other, extended in a longitudinal direction, and disposed on one side of the insulating substrate; and, a recess formed in the insulating substrate on a side of a grounded member opposite to the microstrip lines with a width and a depth disposed in the longitudinal direction, wherein the recess is filled with a material having a dielectric constant smaller than a dielectric constant of the insulating substrate.

6. The microstrip coupler of claim 5, wherein the insulating substrate is formed on a conductive grounded member.

* * * * *